United States Patent [19]

Kawaziri et al.

[11] 3,996,057

[45] Dec. 7, 1976

[54] HEAT DEVELOPMENT PROCESS FOR FORMING IMAGES UTILIZING A PHOTOGRAPHIC MATERIAL CONTAINING A METAL LAYER AND AN INORGANIC MATERIAL LAYER

[75] Inventors: Kazuhiro Kawaziri; Yuzo Mizobuchi; Takeshi Tomotsu, all of Asaka, Japan

[73] Assignee: Fuji Photo Film Co., Ltd., Minami-ashigara, Japan

[22] Filed: Dec. 23, 1975

[21] Appl. No.: 643,653

Related U.S. Application Data

[63] Continuation of Ser. No. 422,487, Dec. 6, 1973, abandoned.

[30] Foreign Application Priority Data

Dec. 7, 1972 Japan ..... 47-123130

[52] U.S. Cl. ..... 96/484 D; 96/67; 96/68; 96/88; 96/36; 96/36.2

[51] Int. Cl.[2] ..... G03C 5/24

[58] Field of Search ..... 96/48 R, 48 HD, 67, 96/68, 88, 76 R, 36, 36.2; 252/501

[56] References Cited

UNITED STATES PATENTS

| | | | |
|---|---|---|---|
| 3,637,377 | 1/1972 | Hallman et al. | 96/36.2 |
| 3,637,378 | 1/1972 | Hallman et al. | 96/88 |
| 3,637,379 | 1/1972 | Hallman et al. | 96/88 |
| 3,637,381 | 1/1972 | Hallman et al. | 96/88 |
| 3,637,383 | 1/1972 | Hallman et al. | 96/88 |
| 3,707,372 | 12/1972 | Hallman et al. | 96/36.2 |

*Primary Examiner*—Won H. Louie, Jr.

*Attorney, Agent, or Firm*—Sughrue, Rothwell, Mion, Zinn & Macpeak

[57] ABSTRACT

A method for forming an image, which comprises subjecting an image-recording material comprising a metal layer and an inorganic material layer to imagewise exposure by application of electromagnetic radiation, and then heating the exposed material to cause a thermal doping of the unexposed area of the metal layer. This method permits the formation of negative-positive type images. The product finds a wide range of valuable industrial applications, for example, as an ordinary image-recording material, laser recording material, electron beam recording material or microrecording material, and also for producing a print-wiring plate, relief metal plate for relief and lithographic printing, or a master for electrostatic printing.

4 Claims, 21 Drawing Figures

HEAT DEVELOPMENT PROCESS FOR FORMING IMAGES UTILIZING A PHOTOGRAPHIC MATERIAL CONTAINING A METAL LAYER AND AN INORGANIC MATERIAL LAYER

This is a continuation, of application Ser. No. 422,487, filed Dec. 6, 1973, now abandoned.

BACKGROUND OF THE INVENTION

1. Field of the Invention

This invention relates to a process for forming an image and to an image recording material. More specifically, it relates to a process for forming an image using a metal layer and an inorganic material layer which are superimposed, and to an image recording material for use in such a process.

2. Description of the Prior Art

It is already known from the disclosures of U.S. Pat. No. 3,637,377 – 381 that when a certain metal and an inorganic compound are superimposed by, for example, vacuum evaporation, and then subjected to electromagnetic radiation, the irradiated part of the metal layer diffuses into the inorganic compound layer, and the luster of that part of the metal layer disappears. This phenomenon is also called photodoping because the metal is doped utilizing light, and various methods for forming images utilizing this phenomenon have been proposed.

According to photodoping, positive-positive type images are always obtained since the exposed portion of the metal layer diffuses into the inorganic compound layer. It is impossible therefore to utilize photodoping when negative-positive type images are desired.

In the course of our investigations into the formation of images using heat, it was found surprisingly that when a metal layer and an inorganic compound layer are superimposed and after exposure, heated, the metal layer at the unexposed areas diffuses into the inorganic commpound layer and the luster of these portions disappears (this phenomenon will be referred to hereinafter as "thermal doping").

It is therefore an object of this invention to provide a process for forming negative-positive type images.

Another object of this invention is to provide an image forming material capable of furnishing negative-positive type images.

SUMMARY OF THE INVENTION

According to this invention, there is provided a process for forming images, which comprises applying electromagnetic radiation to an image recording material having a multilayered structure of a metal layer and an inorganic material layer, and then heating the recording material.

BRIEF DESCRIPTION OF THE ACCOMPANYING DRAWINGS

Figure 1:
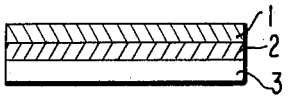
FIGS. 1 to 4 show typical multilayered structures of an image-forming material to which the process of this invention can be applied.

FIGS. 9 to 21 also illustrate the process of this invention and the material used therefor.

DETAILED DESCRIPTION OF THE INVENTION

It is not entirely clear whether thermal doping is ascribable to the mere thermal diffusion of the metal layer, the thermal decomposition of the inorganic compound layer, the thermal reaction between the metal and the inorganic compound, or the thermal reaction between the metal layer and a thermal decomposition reaction product of the inorganic compound layer. However, in view of the fact that the metal layer disappears upon heating and the inorganic compound layer at the portions corresponding to those portions of the metal layer which have disappeared have properties different from those after the mere heating of the inorganic compound layer, it is presumed that some change occurs either partly or wholly between the metal that has disappeared by heating and the corresponding inorganic compound to form a product (which will be referred to hereinbelow as an interreaction product). In other words, it is assumed that some reaction occurs between the metal layer and the inorganic compound layer as a result of the radiation of electromagnetic waves reaching the interface between the two layers, and a new layer which exhibits a thermal doping temperature different from that of the unirradiated portion is formed. The term "thermal doping temperature,"as used herein, denotes the lowest temperature at which thermal doping is observed. The thermal doping temperature in the unexposed areas is generally about 70° C to 300° C and in the exposed areas generally is about 100° to 350° C. The difference in the these two temperatures is more than 50° C, preferably more than 20° to 30° C. Even if the thickness of the layers is the same, the thermal doping temperature differs depending upon the combination of the metal and the inorganic compound.

Typical examples of inorganic material lavers, metal layers and the corresponding thermal doping temperatures are as follows:

| Inorganic Material Layer | Metal Layer | Thermal Doping Temperature Unexposed Area | Exposed Area |
|---|---|---|---|
| $As_{30}S_{70}$ | Cd | 70° C | 100° C |
| $As_{40}S_{60}$ | Ag | 180° C | 220° C |
| $As_{40}Se_{60}$ | Ag | 120° C | 140° C |
| $As_{40}S_{70}$ | Tl | 110° C | — |
| $As_{40}S_{70}$ | Zn | 180° C | — |
| $As_{40}S_{70}$ | Mn | 300° C | — |
| $As_{40}S_{70}$ | Pb | 300° C | — |
| $As_{20}S_{80}$ | Ag | 230° C | — |
| $As_{60}S_{40}$ | Ag | 120° C | — |
| $Sb_{30}S_{40}I_{20}$ | Ag | 110° C | 120° C |

Thus, by applying heat energy to the entire structure in such a condition, the metal at the unirradiated portions is thermally doped into the inorganic compound. At the time when this thermal doping has been completed and the luster of the metal has disappeared, the metal layer at the irradiated portions still remains without thermal doping. If heating is stopped, the metal layer at the irradiated portions remains, but the unirradiated portions disappear due to the thermal doping, thereby to give a clear image.

More specifically, therefore, the process of this invention comprises applying electromagnetic radiation imagewise to a material having a multilayered structure of a metal layer capable of being thermally doped by heat energy and an inorganic material layer and also having a lower thermal doping temperature at the unirradiated portions than at the portions irradiated by electromagnetic waves, and then heating the material.

The initial application of electromagnetic radiation is intended to form a very thin layer capable of changing the thermal doping temperature at the interface between the metal and the inorganic compound. Even when a combination of the metal and the inorganic compound has the property of inducing photodoping, the metal layer should remain in a sufficient thickness. The initial electromagnetic radiation, therefore, does not at all give an image, or at best only a very slight optical difference is detected between the irradiated portions and the non-irradiated portions. Application of heat energy to the material in this condition results in the doping of the metal layer at the non-irradiated portions. This procedure is quite different from conventional photodoping, and exhibits very superior characteristics in practical applications.

To put it another way, the process of this invention is one whereby latent images are first formed by applying electromagnetic radiation to an image forming material having a multi-layered structure of a metal layer and an inorganic compound layer, and then developed by applying heat energy thereto.

The point at which the process of this invention is phenomenally distinguished clearly from photodoping is that the images obtained by the process of this invention are quite reverse in brightness and darkness from those obtained by photodoping. This fact is very effectively utilized in practical application. This will be explained below by reference to a typical example of an image-forming material applicable both to the process of this invention and to the photodoping process. When the process of this invention is carried out using this material, the metal layer remains at the parts irradiated with electromagnetic radiation. Observation of these parts using transmitting light shows that these parts constitute a dark area absorbing the light. When, however, the photodoping method is applied to such an image-forming material, the metal layer irradiated with electromagnetic radiation disappears to form a light area which permits the transmission of the light. Accordingly, the process of this invention gives a copy with light and dark areas reverse to those of the original, whereas the photodoping method gives a copy having the same relationship of light and dark areas as those of the original. In other words, the copy obtained by the process of this invention is a negative-positive type copy, and the copy obtained by the photodoping method is a positive-positive type copy.

Thus, while copies obtained by the conventional photodoping method have been limited to the positive-positive type, the application of the step of heating in accordance with the process of this invention makes it possible to furnish negative-positive type copies. This clearly demonstrates that the process of this invention is of extreme commercial advantage.

While both the photodoping method and the process of this invention can be applied to a material of a multi-layered structure of a metal layer and an inorganic compound layer, the exposure time required to remove the metal layer in the process of this invention is 1/10 to 1/100 of that required in the photodoping method using the same light source, although it varies somewhat depending on the thickness of the metal layer. Even using the same material, however, its light sensitivity is increased to 10 to 100 times. As already stated, exposure merely leads to the formation of a latent image, and subsequently, a step of thermal development is performed. In a sense, therefore, this development step constributes to sensitization. The time required for this thermal development step (thermal doping) may be short, and sufficiently on the order of several seconds. This also adds to the utility value of the process of this invention.

Suitable light sources for providing electromagnetic radiation of which the wavelength is about 2000 A to 1 $\mu$, are a tungsten lamp, a halogen lamp, a xenon lamp, a mercury lamp, etc. Suitable exposure times can range from about 0.1 second to 2 hours, preferably, 1 second to 60 minutes.

As stated above, the present invention comprises first applying electromagnetic radiation to an image-forming material and then heating the material to form an image. The metal layer remains at the irradiated area, and an interreaction product by thermal doping is formed in the unirradiated area. Consequently, a difference in chemical or physico chemical properties between the irradiated area and the unirradiated area results, and by utilizing this difference, the process of this invention can find various applications.

The invention will further be described in detail by reference to the accompanying drawings.

Figure 2:
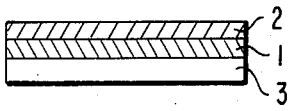
Figure 3:
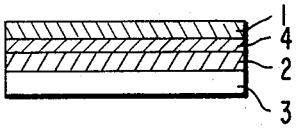
Figure 4:
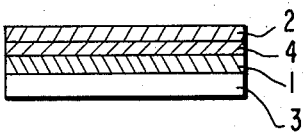

Referring to FIGS. 1 to 4, the reference numeral 1 represents a metal layer; 2, an inorganic material layer; 3, a support; and 4, an interlayer. In FIG. 1, the inorganic material layer 2 is first formed on the support 3, and then the metal layer 1 is formed on top of it. In FIG. 2, the metal layer 1 is first formed on the support 3, and then the inorganic material layer 2 is formed on top of it. In FIG. 3, the interlayer 4 is formed between the metal layer 1 and the inorganic material layer 2 of the image-forming material shown in FIG. 1. FIG. 4 shows that the interlayer 4 is provided between the inorganic material layer 2 and the metal layer 1 of the image-forming material shown in FIG. 2. This interlayer 4 is a metal layer, an inorganic material layer, or a laminate of these layers, and can be a single such layer or a laminate of a plurality of such layers. Preferably, the interlayer 4 is different in kind from the metal layer 1 or the inorganic material layer 2.

The support 3 can be of any material which has rigidity and can withstand the thermal doping temperatures. Usually, glass sheets, resin films such as films of polyethylene terephthalate, triacetyl cellulose, diacetyl cellulose, polycarbonate, nylon, etc. or metal plates such as aluminum, zinc, copper, iron, etc. are utilized as such a material.

Typical examples of metals which can be used as the metal layer 1 are silver, copper, tin, zinc, nickel, chromium, manganese, cadmium, magnesium, tellurium, gallium, aluminum, bismuth and gold. A suitable thickness for the metal layer can range from about 10 A to 1 $\mu$, preferably 100 A to 2000 A. Examples of inorganic materials for the inorganic material layer 2 are elemental sulfur, selenium halides, sulfides, arsenides, selenides, tellurides, and binary or ternary chalcogen compounds of which elements are selected from elements such as germanium, arsenic, sulfur, selenium, tellurium, antimony, bismuth, phosphorus or aluminum. Typical chalcogen compounds include, for example, binary chalcogen compounds such as As-S, As-Se, As-Te, Ge-S, Ge-Se, S-Se, Sb-S, Sb-Te, Bi-S, Bi-Se, or Bi-Te, and ternary chalcogen compounds such as As-S-Se, As-S-Te, As-Se-Te, Ge-As-S, Ge-As-Se, Ge-As-Te, Ge-P-S, Ge-Al-S, Ge-Bi-S or Ge-Sb-S. A suitable thickness of the inorganic material layer can range from about 50 A to 10 $\mu$, preferably 500 A to 2 $\mu$.

Where the interlayer 4 is a single layer of a metal or an inorganic material, the metals or the inorganic compounds exemplified above can be freely selected from the embodiments set forth above. When the interlayer 4 is a metal layer and an inorganic material layer, the metals and the inorganic materials are appropriately selected from those illustrated above. A typical combination is silver plus arsenic trisulfide.

The metal layer 1 can be formed by various known methods such as vacuum evaporation, sputtering, chemical plating, or bonding of metal foils. The inorganic material layer 2 and the interlayer 4 can generally be formed by vacuum evaporation or sputtering. These techniques are, for example, disclosed in L.I. Maissel, *Handbook of Thin-Film Technology*, McGraw-Hill Co. (1970).

When electromagnetic radiation is applied imagewise to the image-forming material of the structure shown in FIGS. 1 to 4, the electromagnetic radiation is either transmitted or absorbed according to the light and dark areas of an image pattern 5, thus making it possible to provide an irradiated area and a non-irradiated area on the image-forming material.

Figure 5:
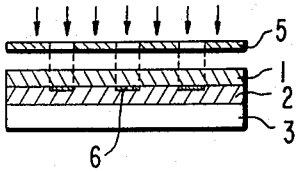
FIGS. 5 to 7 are views illustrating one embodiment of this invention using an image-forming material of the structure shown in FIG. 1.
Figure 6:
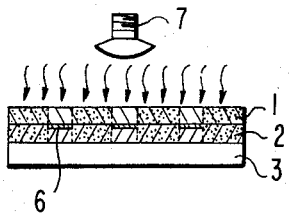
Figure 7:
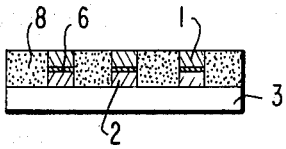

Referring to FIGS. 5 and 6, a layer of the non-irradiated area of the image-forming material does not undergo any change but maintains the original state, while an interreaction product 6 between the metal layer 1 and the inorganic material layer 2 is formed on the interface between the non-irradiated layer and the irradiated layer. When the interreaction product layer 6 causes an increase in the thermal doping temperature, the metal layer 1 at the non-irradiated area is thermally doped at a temperature lower than at the irradiated area on heating the entire layer using a heat source 7 as shown in FIG. 6. When the supply of heat energy is stopped upon completion of the thermal doping of the metal layer 1 at the non-irradiated area, an image of sufficient contrast is obtained, as shown in FIG. 7, which is composed of the metal layer 1 and an interreaction product layer 8 formed between the metal layer 1 and the inorganic material layer 2 caused by thermal doping.

Figure 8:
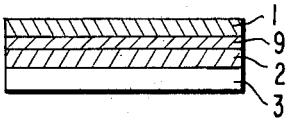
FIGS. 8 to 15 are views illustrating one embodiment of this invention using an interlayer 4 shown in FIG. 3.

FIG. 8 shows an image-forming material in which a metal interlayer 9 is used as the interlayer 4. When the metal layer 1 and the inorganic material layer 2 can be thermally doped with each other but an interreaction product layer 6 cannot be formed in the interface between these layers by the application of electromagnetic irradiation, the method of this invention can be applied by using the metal interlayer 9 capable of forming the interreaction product layer 6 as the interlayer 4.

Figure 9:
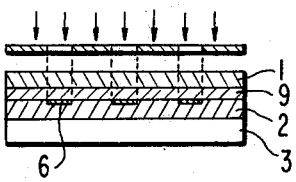
Figure 10:
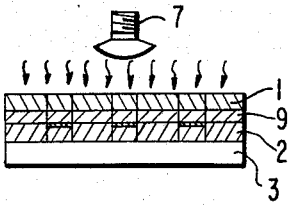
Figure 11:
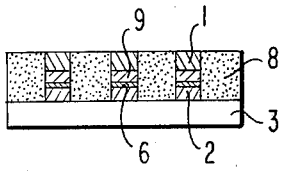

As shown in FIG. 9, when electromagnetic radiation is applied to the image-forming material shown in FIG. 8 through an image pattern, the interreaction product layer 6 is formed in the interface between the metal interlayer 9 and the inorganic material layer 2. When this layer 6 causes an increase in the thermal doping temperature, the metal layer 1 at the non-irradiated area is thermally doped at a temperature lower than at the irradiated area by heating (for example, at a temperature of 70° C to 300° C for about 1 second to 10 minutes) with a heat source 7 as shown in FIG. 10. When the heating is stopped on completion of the thermal doping of the metal layer 1 of the unirradiated area, the surface of the image-forming material is composed of the metal layer 1 and the interreaction product layer 8 formed by thermal doping, and an image having sufficient contrast can be obtained.

Figure 12:
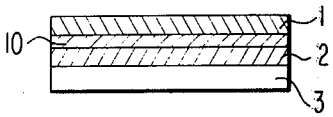
Figure 13:
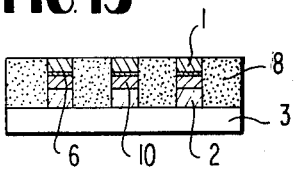

FIG. 12 illustrates an image-forming material using an interlayer 10 of an inorganic material as the interlayer 4 as shown in FIG. 3. When the metal layer 1 can be thermally doped in the inorganic material layer 2, but the irradiation of electromagnetic radiation cannot lead to the formation of the interreaction product layer 6 at the interface, the process of this invention can be applied by forming the interlayer 10 of an inorganic material capable of forming an interreaction product layer 6 with the metal layer 1. FIG. 13 illustrates the structure wherein electromagnetic radiation is applied to the image-forming material shown in FIG. 12 through an image pattern, and then the material is heated to thermally doping the metal layer 1. In this case, the interreaction product layer 6 is formed at the interface between the metal layer 1 and the interlayer 10 of an inorganic material.

Figure 14:
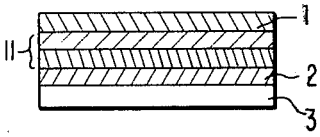

FIG. 14 illustrates an image-forming material in which an interlayer 11 composed of a metal layer and an inorganic material layer is formed as the interlayer 4 as shown in FIG. 3. When the metal layer 1 can be thermally doped in the inorganic material layer 2, but it is comparatively difficult to determine a combination of the metal layer 1 and the inorganic material layer 2 which permits the formation of the interreaction product layer 6 by the application of electromagnetic radiation, the process of this invention can be applied by selecting as the interlayer 4 a combination of a metal and an inorganic material which forms an interreaction product layer 6 by the application of electromagnetic radiation, and forming an interlayer 11 composed of this combination between the metal layer 1 and the inorganic material layer 2. When electromagnetic radiation is applied to such an image-forming material through an image pattern, the interreaction product layer 6 can be formed at the interface in the interlayer 11 itself, and by the formation of this layer 6, the thermal doping temperature of the irradiated area can be increased over that of the non-irradiated area, and therefore, an image can be formed by heating.

Figure 15:
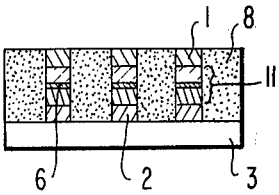

FIG. 15 shows the state of formation of an image after the application of electromagnetic radiation to the material shown in FIG. 14 and then heating it.

As stated above, the basic structure of the image-forming material that can be used in the method of this invention is as shown in FIGS. 1 and 2. The requirement of this image-forming material is that the metal layer 1 and the inorganic material layer 2 can be thermally doped, the application of electromagnetic radiation leads to the formation of the interreaction product layer 6 in the interface between the two layers, and that this layer 6 causes the thermal doping temperature of the irradiated area to be higher than that of the non-irradiated area. However, if there is even one kind of such a combination of material, the method of this invention can be applied to all combinations of metals and inorganic materials that can be thermally doped. The interlayer 4 is used not only for applying the method of this invention, but also it can be generally employed as means for controlling the characteristics of the material as desired.

The surface of the image obtained by the method of this invention is composed of the metal layer 1 and the interreaction product layer 8, and the irradiated area and the non-irradiated area can be detected by due to the differences in the physical chemical or physicochemical properties of these layers. By utilizing the difference in these properties, the present invention can be used in various industrial applications.

In short, the essence of this invention is that while the metal layer 1 at the part irradiated with electromagnetic radiation remains, the unirradiated, thermally doped part changes to the interreaction product layer 8 which has different optical properties, solubility, electrical resistance, adsorbability and surface wetness from the metal layer 1.

Optically, the interreaction product layer 6 obtained by thermal doping has an increased light transmittance and a reduced light reflectance as compared with the metal layer 1. Accordingly, observation of an image containing an irradiated area and a thermally doped non-irradiated area using transmitting light shows that the irradiated area becomes a dark area as a result of the absorbance of the light by the remaining metal layer 1, and the interreaction product layer 8 permits the transmission of a large amount of light and becomes a light area. In this case, the thickness of the metal layer 1 affects the contrast of the image. When the image is observed using reflecting light, the irradiated area exhibits a metallic luster of the metal layer 1, whereas the interreaction product layer 8 becomes a dark area because its degree of reflection decreases. The darkness and the lightness are thus reversed from those observed using transmitting light, but an image having a clear contrast can be obtained. This difference in optical properties can be detected not only by the naked eye, but also instrumentally, for example, polarographically.

With regard to the solubility, a solution which dissolves either the metal layer 1 or the interreaction product layer 6 but does not dissolve the other can be selected. For example, when chalcogen compound is used as the inorganic material layer 2, it is corroded by alkali such as NaOH, KOH, LiOH, $Ba(OH)_2$, $Na_2CO_3$, $K_2CO_3$, $Li_2CO_3$, $Na_3PO_4$, etc., suitably used as an aqueous solution thereof, but has acid resistance. On the other hand, an oxidizing acidic solution such as $K_2Cr_2O_7$-$H_2SO_4$-$H_2O$, $CuCl_2$, $Cu(NO_3)_2$, $CuSO_4$, $K_3Fe(CN)_6$, etc., suitably as a water solution thereof or appropriately in combination with NaCl can be used for dissolving the metal layer 1. The interreaction product layer 8 has an increased resistance to alkali. Accordingly, each of these three layers can be selectively dissolved and removed.

Figure 16:
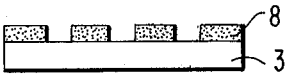

This will be described further by reference to the drawings. As shown in FIG. 7, the image formed by the method of this invention is treated with an acid to dissolve an remove the metal layer 1. If, for example, the metal layer 1 is silver, it can be dissolved and removed by the action of a chromic acid mixed solution. After the dissolution and removal of the metal layer 1 in this way, a hydroxide of lithium, sodium or potassium is caused to act on the inorganic material layer 2 when this layer is composed, for example, of a chalcogen compound. The chalcogen compound layer 2 is first dissolved and removed since there is a difference in solubility between the chalcogen compound layer 2 and the layer 6 of an interreaction product between the metal and the chalcogen compound. Finally, therefore, a pattern of the interreaction product layer 8 remains, as shown in FIG. 16.

Figure 17:
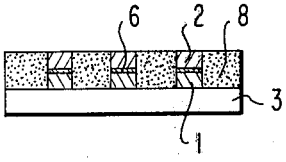
Figure 18:
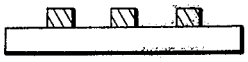

FIG. 17 shows the structure of the image obtained by applying the method of this invention to the image-forming material having the construction shown in FIG. 2. If chalcogen compound is used as the inorganic material layer 2, the application of an alkali solution results in the dissolution and removing of the chalcogen compound in the inorganic material layer 2, and then the interreaction product layer 8 obtained by the thermal doping of the chalcogen compound and the metal is dissolved and removed. Finally, a pattern of the metal layer 1 remains, as shown in FIG. 18.

Accordingly, by utilizing the solubility of each of the layers, an image pattern of the desired material can be formed.

The electric resistance of the interreaction product layer 8 differs from that of either the metal layer 1 or the inorganic material layer 2. The usual tendency is that the electric resistance increases in the order of the metal layer 1, the interreaction product layer 8, and the inorganic material layer 2. Even if a combination of the same metal and the same inorganic material is used, the resulting interreaction product layer 8 has a different electrical resistance according to the amount of heat energy applied at the time of thermal doping, or the energy level. Accordingly, since the surfaces of the images obtained by the method of this invention as shown in FIGS. 7, 11, 13, 15 and 17 are composed of the metal layer 1, the inorganic material layer 2 and the interreaction product layer 8, a pattern is formed in which there is a difference in electric resistance. Furthermore, even when one of the layers is dissolved and removed by utilizing the difference in solubility between the individual layers, a pattern having a different electrical resistance between the layers is formed.

Furthermore, the absorbability and surface wetness sometimes differ among these layers.

Thus, as stated above, the metal layer 1, the inorganic material layer 2 and the interreaction product layer 8 which constitute the image obtained by the method of this invention differ from each other markedly in physical, chemical and physicochemical properties. Accordingly, by utilizing these changes in characteristics, the method of this invention finds a wide variety of commercial utility.

The utility of the images obtained by the method of this invention will be described.

Naturally, by utilizing changes in optical characteristics the products of this invention can be used as image-recording materials. As already stated, the light and dark areas of the image obtained by the method of this invention are reverse depending on whether it is seen using transmitted light or using reflected light. Furthermore, the image obtained by the method of this invention has light and dark areas opposite in relationship to those of the image obtained by the photodoping method. Thus, when the method of this invention is employed conjointly with the photodoping method, a negative image and a positive image can be chosen as desired using either transmitted light and a reflected light, and this image system can be applied to a very wide range of utility. The image system in accordance with this invention can supersede all image systems now in use, and presents many great advantages.

The highest quality image obtained by the method of this invention requires exposure of only 20 seconds at a distance of 25 cm from a 100 W mercury lamp, and is included within those of very high sensitivity among similar systems. Its resolving power is as high as 500/mm. Thus, the image-forming material in accordance with this invention is also useful as a laser recording material, an electron beam recording material, a microrecording material, an IC pattern material, and other general recording materials. Where the resolving power need not be high as in the case with general recording materials, a material with a relatively large coating thickness can be utilized, and therefore, a good quality image of high contrast can be obtained.

The high sensitivity attained by the method of this invention is ascribable to the thermal developing step, and thus, the sensitivity in photodoping is still low. Accordingly, the material can be stored for long periods of time in the unfixed state without any impairing of its utility.

When the image-forming material of this invention is used for general recording purposes, the resolving power is relatively high, and it can be used as a negative-positive type without any need to use a solution. Furthermore, it has the advantage of moderate sensitivity.

Where the inorganic material layer has a transmittance higher than that of the interreaction product layer, an image ascribable to the reversed inorganic material layer can be obtained by dissolving and removing the remaining metal layer. In a sense, this corresponds to the operation of fixation.

The material in accordance with this invention has utility in printed wirings, printed resistances, the formation of metal reliefs, and etch resists.

Figure 19:
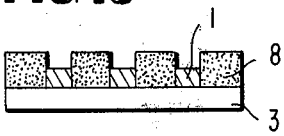

When intended for use in print wiring, the image-forming material of the construction shown in FIG. 2 is used and irradiated with electromagnetic radiation through a negative pattern of the required print wiring, followed by heating. Thus, the layer corresponding to the part of the print wiring is irradiated, and by heating, the unirradiated part is thermally doped, whereupon the metal layer 2 disappears and the interreaction product layer 8 is formed, as shown in FIG. 17. When a suitable etching solution is caused to act on this material to dissolve out the inorganic material layer 2, the resulting construction is as shown in FIG. 19. The resulting material can be used directly as a print wiring plate, but it is also possible to dissolve and remove the interreaction product layer 8 further to provide a structure consisting only of a metal pattern as shown in FIG. 18. Or such a material can further be electrically plated to add to the wiring portion. The base plate that can be used for this purpose can, for example, be a bakelite plate, or glass-epoxy resin plate. The metal layer is preferably composed of silver or copper and prepared by vacuum evaporation, sputtering, chemical plating or bonding of foils.

As regards the production of a printed resistance, the required resistance elements are obtained by application of electromagnetic radiation and subsequent heating at the required parts according to the design of an electric circuit. This is based on the utilization of the fact that the interreaction product layer can be obtained as an image and simultaneously, the electric resistance can be varied and controlled within a certain range. They are used as electric resistance elements printed in advance onto an electric circuit.

Figure 20:
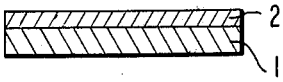
Figure 21:
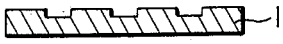

In order to obtain a metal relief, an image-forming material of the structure shown in FIG. 20 is used. The inorganic material layer 2 is formed on the metal plate 1 on which to form a relief, and the material is subjected to electromagnetic radiation through the desired pattern and then heated. The unirradiated area forms the interreaction product layer 8 as a result of thermal doping between the surface portions of the inorganic material layer 2 and the metal plate 1. A metal relief plate of the type shown in FIG. 21 can be obtained by dissolving and removing the inorganic material layer 2 and the interreaction product layer 8 of the resulting material. The resulting metal relief plate can be used as a printing plate for relief printing and lithographic printing.

In order to produce an etch resist, the material shown in FIG. 16 or 18 is treated, and then the interreaction product layer 8, and the metal layer 1, etc. are used as the resists. Of course, the combination of the inorganic material layer and the metal layer must be such that these layers are not attacked by the etching solution, and at the same time, the substrate plate must be of a material which can be etched.

As already stated, the interreaction product layer, the metal layer 1 and the inorganic material layer 2 exhibit different electrical resistances, and utilizing this, the material can be used as a print resistance. Another utility of such a resistance pattern is to utilize it as a master for electrostatic printing. This method is based on the utilization of electrophotographic techniques wherein when the resistance pattern is subjected to a charging treatment, the charge is maintained at the part having a high resistance but dissipated at the part having a low resistance, and therefore, the resistance pattern is converted to a charge pattern through the step of charging.

For example, when electromagnetic radiation is applied imagewise to the image-forming material, the surface of the material is composed of the metal layer and the interreaction product layer. Although the metal layer cannot retain an electric charge, the interreaction product layer can retain a charge. Accordingly, a charge pattern can be formed. After the formation of such an electric charge pattern, it is developed with a developer, such as a colored powder, which is charged in an opposite polarity to that of the charge pattern, thereby forming an image of the colored powder. A visible image can be obtained by fixing it directly, or after transferring it to another support by any desired method. When used for this purpose, the combination of layers in the image-forming material is not limited to that illustrated above, but almost all constructions already described above can be utilized.

Images of higher contrast can be obtained by differentiating any desired layer using a coloring material or a dye, etc. on the basids of the difference in adsorbability among the constitutent layers after irradiation with electromagnetic radiation.

Furthermore, by utilizing the difference in water absorption between the irradiated area and the non-irradiated area, a non-treated planographic plate can be obtained. For example, when aluminum is used as a metal layer, the aluminum layer remains in the unirradiated area, and therefore, it can be made hydrophilic by coating it with gum arabic, for example. Furthermore, if the surface is rubbed with a lacquer containing water, the lacquer adheres to the interreaction product layer. Since hydrophilic and oleophilic portions can be thus obtained imagewise, the resulting material can be used as an offset or planographic printing plate. In this case, only the exposure to electromagnetic radiation is required, and without other treatments, the material can be used as a printing plate. When any of the layers is dissolved out, the resulting material can still be used as a lithographic printing plate. For example, by rendering the base plate hydrophilic and rendering the interreaction product layer, the metal layer, and the inorganic material layer oil-sensitive, the resulting material can be used as a lithographic printing plate of the positive type.

As described in detail above, the image-forming material of this invention can be used not only as a mere image-recording material, but also has a wide range of utility on the basis of the fact that application of electromagnetic radiation causes drastic changes in the physical, chemical or physicochemical properties between the irradiated area and the non-irradiated area.

The following Examples illustrate some embodiments of the present invention. Unless otherwise indicated, all parts and percents are by weight.

EXAMPLE 1

A granular chalcogen compound $As_2Se_3$ having a purity of 99.999% was pulverized. 80 mg of the pulverized chalcogen compound was placed in a tungsten basket coated with alumina, and vacuum evaporated and deposited on a grained aluminum base plate at $5 \times 10^{-5}$ torr. Then, 40 mg of silver (purity 99.99%) was vacuum evaporated and deposited on the chalcogen compound layer to form a multilayered coating composed of $As_2Se_3$-Ag. The distance between a tungsten heater as an evaporation source and the base plate was about 10 cm. A film having an image pattern was brought into intimate contact with the $As_2Se_3$-Ag multilayered coating, and exposed for 20 and 60 seconds from a 500 W tungsten-filament lamp placed 30 cm away from the plate. At this time, hardly any image was seen on the surface of the plate. When the plate was heated by a hot plate held at 100° to 140° C, the silver in the unexposed area disappeared and the silver at the exposed area remained to provide a clear image. The optimum exposure time for obtaining this image was about 40 seconds.

EXAMPLE 2

Using the same material and the same method as described in Example 1, 80 mg of $As_2Se_3$and 40 mg of Ag were successively deposited in vacuum to form a multilayered coating on a glass base plate. The plate was exposed imagewise for 3 minutes in the same manner as described in Example 1 from the Ag layer side of the coating. When the plate was heated by a hot plate held at 100° to 140° C, the silver at the exposed area remained and the silver at the unexposed area disappeared to provide a clear image.

EXAMPLE 3

Using the same method as described in Example 1, 60 mg of $As_2S_3$ having a purity of 99.99% and 40 mg of the same Ag used in Example 1 were vacuum evaporated and deposited on a glass base plate to form a multilayered coating of $As_2S_3$. The plate was exposed imagewise for 1 to 3 minutes using the same method as described in Example 1 from the $As_2S_3$ side of the multilayered coating. At this time, hardly any image could be seen from the Ag layer side. When the plate was then heated by a hot plate held at about 200° C, the silver at the non-exposed portion disappeared and the silver at the exposed portion remained to provide a clear image. The suitable exposure time in this Example was 1.5 minutes.

EXAMPLE 4

A multilayered coating of $As_2S_3$-Ag obtained by the same method as in Example 3 using the same material as in Example 3 was heat-treated for 5 to 60 seconds on a hot plate held at 180° C, then exposed imagewise for 20 seconds to 5 minutes in the same manner as described in Example 1 from the $As_2S_3$ side, and subsequently, heated on a hot plate held at about 200° C. The silver disappeared at the non-exposed area but remained at the exposed area to provide an image. The amount of the residual silver in the exposed area changed depending on the exposure time.

EXAMPLE 5

Using the same method as described in Example 3, 60 mg of the same $As_2S_3$ as used in Example 3 was vacuum evaporated and deposited on a glass base plate, and then 40 mg of the same Ag as used in Example 3 was vacuum evaporated and deposited on top of it. Finally, 20 mg of zinc (purity 99.99%) was likewise vacuum evaporated and deposited on top of the Ag layer to produce a multilayered coating. The plate was exposed imagewise for 1.5 minutes using the same method as described in Example 1 from the $As_2S_3$ layer side of the coating, and then heated on a hot plate held at about 200° C. The zinc remained at the exposed area, and disappeared at the unexposed area to provide an image. Similar results were obtained when Al or Cu having a purity of 99.99% was used instead of the zinc.

EXAMPLE 6

Each of the coatings of $As_2S_3$-Ag-Zn and $As_2S_3$-Ag-Al obtained in Example 5 and having an image thereon was dipped in a dilute aqueous solution of HCl for several seconds, and washed with water. A difference in water wetting was observed between the Zn or Al surface remaining in the exposed area and the thermally doped surface.

EXAMPLE 7

Using the same method as described in Example 1, 40 mg of $Sb_2S_3$ having a purity of 99.99%, 30 mg of $As_2S_3$, and 40 mg of the same Ag as used in Example 3 were vacuum evaporated and deposited on a glass base plate successively in this order to form a multilayered coating. The plate was exposed imagewise for 3 minutes in the same method as in Example 1 from the $Sb_3S_3$ layer side, and heated on a hot plate held at 200° C. The Ag at the unexposed area disappeared, and an image could be formed. When Se or $As_2Se_3$ was used instead of the $Sb_2S_3$, the same results were obtained.

EXAMPLE 8

Using the same method as described in Example 3, 30 mg of Se having a purity of 99.99%, 40 mg of the same $As_2S_3$ as used in Example 3, 30 mg of the same Ag as used in Example 3, and 20 mg of Zn having a purity of 99.99% were vacuum evaporated and deposited successively in this order on a glass base plate. The plate was exposed imagewise for 4 minutes using the same method as described in Example 1 from the Se layer side, and then heated on a hot plate held at about 190° C. The Zn layer remained at the exposed area, and was thermally doped at the unexposed area to provide an image.

In the foregoing Examples 2 to 8, similar results were obtained when using a glass/metal layer/chalcogen coating material.

EXAMPLE 9

Using the same method as described in Example 1, 25 mg of silver having a purity of 99.99%, and 50 mg of sulfur having a purity of 99.99% were vacuum evaporated and deposited on a 150 $\mu$ thick polyester base plate to form a silver/sulfur multilayered coating. The plate was exposed imagewise for 5 minutes using the same method as described in Example 1 from the sulfur side of the coating. The plate was then heated on a hot plate held at 90° C. The silver disappeared at the unexposed area, but remained at the exposed area to provide a clear image.

While the invention has been described in detail and with reference to specific embodiments thereof, it will be apparent to one skilled in the art that various changes and modifications can be made therein without departing from the spirit and scope thereof.

What is claimed is:

1. A method for forming an image, which comprises imagewise irradiating with electromagnetic radiation of a wavelength of about 2,000 A to 1 $\mu$, a multi-layer image-recording material comprising a metal layer and an inorganic material layer in contact with said metal layer and capable of forming an interreaction product with said metal layer, so that the non-irradiated areas of said metal layer become thermally dopable at a temperature lower than the temperature for thermally doping the irradiated areas of said metal layer, upon irradiation with said electromagnetic radiation of a wavelength of about 2,000 A to 1 $\mu$, and then heating said material to a temperature to cause diffusion of said metal in the non-irradiated areas into said inorganic material layer, said metal remaining unchanged and undoped after said heating at the areas irradiated with said electromagnetic radiation, said temperature being 70° to 300° C and not causing complete diffusion of metal from said irradiated metal areas, said metal layer being a layer of a metal selected from the group consisting of silver, copper, tin, zinc, nickel, chromium, manganese, cadmium, magnesium, tellurium, gallium, aluminium, bismuth and gold, said inorganic material layer being elemental sulfur, selenium, a halide, a sulfide, an arsenide, a selenide, a telluride, or a chalocogen compound selected from the group consisting of As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Ge-Bi-S or Ge-Sb-S.

2. A method for forming an image, which comprises imagewise irradiating with electromagnetic radiation of a wavelength of about 2000 A to 1 $\mu$, a multi-layer image-recording material comprising an uppermost first metal layer of a metal selected from the group consisting of silver, copper, tin, zinc, nickel, chromium, manganese, cadmium, magnesium, tellurium, gallium, aluminum, bismuth and gold, a second metal layer of a metal selected from the group consisting of silver, copper, tin, zinc, nickel, chromium, manganese, cadmium, magnesium, tellurium, gallium, aluminum, bismuth and gold, and an inorganic material layer of an inorganic material selected from the group consisting of elemental sulfur, selenium, a halide, a sulfide, an arsenide, a selenide, a telluride, and chalcogen compounds As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Ge-Bi-S and Ge-Sb-S, wherein metals of said first and second layers differ each other, said second metal layer positioned between and in contact with said first metal layer and said inorganic material layer, said inorganic material layer capable of forming an interreaction product with said second metal layer so that the non-irradiated areas of said metal layers become thermally dopable at a temperature lower than the temperature for thermally doping the irradiated areas of said second metal layer, upon irradiation with electromagnetic radiation of a wavelength between about 2000 A and 1 $\mu$, and then heating said material to a temperature between 70° C and 300° C to cause diffusion of said metals in the non-irradiated areas into said inorganic material layer, said temperature not causing complete diffusion of metals from said irradiated areas, said metal remaining unchanged and undoped after said heating at the areas irradiated with said electromagnetic radiation.

3. A method for forming an image, which comprises imagewise irradiating with electromagnetic radiation of a wavelength of about 2000 A to 1 $\mu$, a multi-layer image-recording material comprising an uppermost metal layer of a metal selected from the group consisting of silver, copper, tin, zinc, nickel, chromium, manganese, cadmium, magnesium, tellurium, gallium, aluminum, bismuth and gold, a first inorganic material layer of an inorganic material selected from the group consisting of elemental sulfur, selenium, a halide, a sulfide, an arsenide, a selenide, a telluride, and chalcogen compounds As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Ge-Bi-S and Ge-Sb-S beneath of and in contact with said metal layer and capable of forming an interreaction product with said metal layer, and a second inorganic material layer of an inorganic material selected from the group consisting of elemental sulfur, selenium, a halide, a sulfide, an arsendie, a selenide, a telluride, and chalcogen compounds As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Be-Bi-S and Ge-Sb-S positioned beneath and in contact with said first inorganic material layer, wherein inorganic materials of said first and second layers differ from each other, so that the non-irradiated areas of said metal layer become thermally dopable at a temperature lower than the temperature for thermally doping the irradiated areas of said metal layer, upon irradiation with electromagnetic radiation of a wavelength between about 2000 A and 1 $\mu$, and then heating said material to a temperature between 70° C and 300° C to cause diffusion of said metal in the non-irradiated areas into said inorganic material layers, said temperature not causing complete diffusion of metal from said irradiated areas, said metal remaining unchanged and undoped after said heating at the areas irradiated with said electromagnetic radiation.

4. A method for forming an image, which comprises imagewise irradiating with electromagnetic radiation of a wavelength of about 2000 A to 1 $\mu$, a multi-layer image-recording material comprising an uppermost first metal layer of a metal selected from the group consisting of silver, copper, tin, zinc, nickel, chromium, manganese, cadmium, magnesium, tellurium, gallium, aluminum, bismuth and gold, a second metal layer, positioned beneath and in contact with said first metal layer, of a metal selected from the group consisting of silver, copper, tin, zinc, nickel, chromium, manganese, cadmium, magnesium, tellurium, gallium, alumium, bismuth and gold, a first inorganic material layer, positioned beneath and in contact with said second metal layer, of an inorganic material selected from the group consisting of elemental sulfur, selenium, a halide, a sulfide, an arsenide, a selenide, a telluride, and chalcogen compounds As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Ge-Bi-S and Ge-Sb-S and capable of forming an interreaction product with said second metal layer, and a second inorganic material layer, positioned beneath and in contact with said first inorganic material layer, of an inorganic material selected from the group consisting of elemental sulfur, selenium, a halide, a sulfide, an arsenide, a selenide, a telluride, and chalcogen compounds As-S, As-Se, As-Te, Ge-S, Ge-Se, S-Se, Sb-Se, Sb-S, Sb-Te, Bi-S, Bi-Se, Bi-Te, As-S-Se, As-S-Te, As-Se-Te, Ge-As-Se, Ge-As-Te, Ge-P-S, Ge-Al-S, Ge-Bi-S and Ge-Sb-S, wherein metals of said first and second layers differ from each other and inorganic materials of said first and second layers differ from each other, so that the non-irradiated areas of said metal layers become thermally dopable at a temperature lower than the temperature for thermally doping the irradiated areas of said second metal layer, upon irradiation with electromagnetic radiation of a wavelength between about 2000 A and 1 $\mu$, and then heating said material to a temperature between 70° C and 300° C to cause diffusion of said metals in the non-irradiated areas into said inorganic material layers, said temperature not causing complete diffusion of metal from said irradiated areas, said metal remaining unchanged and undoped after said heating at the areas irradiated with said electromagnetic radiation.

* * * * *